US006898919B2

(12) United States Patent
Kim

(10) Patent No.: US 6,898,919 B2
(45) Date of Patent: May 31, 2005

(54) AUTOMATIC TABLET DISPENSING AND PACKAGING SYSTEM

(76) Inventor: Jun Ho Kim, 100-23, Galsandong, Dalsuhgu, Taegu (KR)

( * ) Notice: Subject to any disclaimer, the term of this patent is extended or adjusted under 35 U.S.C. 154(b) by 0 days.

(21) Appl. No.: 10/805,009

(22) Filed: Mar. 18, 2004

(65) Prior Publication Data

US 2004/0182044 A1 Sep. 23, 2004

(30) Foreign Application Priority Data

Mar. 19, 2003 (KR) ..... 10-2003-0017156

(51) Int. Cl.[7] ..... B65B 35/54

(52) U.S. Cl. ..... 53/154; 53/131.4; 53/237; 53/493; 221/92; 221/123; 221/124; 221/133

(58) Field of Search ..... 53/154, 131.4, 53/237, 284.7, 493; 221/92, 123, 124, 133

(56) References Cited

U.S. PATENT DOCUMENTS 4,267,942 A * 5/1981 Wick et al. ..... 221/2
4,664,289 A * 5/1987 Shimizu et al. ..... 221/2
4,790,118 A * 12/1988 Chilcoate ..... 53/411
5,348,061 A * 9/1994 Riley et al. ..... 141/104
5,651,476 A * 7/1997 Percy et al. ..... 221/131
5,839,257 A * 11/1998 Soderstrom et al. ..... 53/411
5,852,911 A * 12/1998 Yuyama et al. ..... 53/168
6,119,892 A * 9/2000 Laurent et al. ..... 221/2
6,145,700 A * 11/2000 Takahashi et al. ..... 221/133
6,367,232 B2 4/2002 Kim
6,449,921 B1 9/2002 Kim
6,471,090 B1 * 10/2002 Inamura et al. ..... 221/124
6,585,132 B2 7/2003 Kim

* cited by examiner

*Primary Examiner*—John Sipos
*Assistant Examiner*—Thanh Truong
(74) *Attorney, Agent, or Firm*—Park & Sutton LLP; John K. Park

(57) ABSTRACT

An automatic tablet dispensing and packaging system includes a tablet packaging unit and a tablet dropping unit that have door cabinets and slider cabinets. The packaging system comprises a front hopper for the door cabinets, and rear hoppers detachably mounted in the base plate to minimize the rebounding of the released tablets, and kinetic force of the tablets being dropped via the corresponding channel.

20 Claims, 6 Drawing Sheets

AUTOMATIC TABLET DISPENSING AND PACKAGING SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of Mar. 19, 2003, with the patent application number 10-2003-0017156, by the applicant. (See the attached Declaration).

BACKGROUND OF THE INVENTION

The invention relates to a pharmaceutical automation system. More particularly, the present invention relates to an automatic tablet dispensing and packaging system having a plurality of hoppers to efficiently guide tablets to a tablet packaging unit while minimizing occurrence of debris or dust resulting from unwanted rebounding of the tablets.

An automatic tablet dispensing and packaging system is generally provided with a tablet packaging portion and a tablet dropping portion placed above the packaging portion. The tablet dropping portion includes a plurality of tablet cassettes containing different sets of tablets. In order to facilitate guiding of tablets to a packaging unit, Korean Utility Model No. 2002-0276183 discloses, as shown in FIGS. 6 and 7, a main body 20, door cabinets 20 connected to the main body 20 by a hinge 20*a*, and cassettes C installed in the cabinets 20. Tablets in the cabinets 10, 20 pass through tablet channels 11, 21 and through hoppers 41, 43 into tablet packaging unit 30. Manually operated tray 31 is provided between the body 20 and the packaging unit 30. Paper roll 32*a* releases paper 32 through guide rod 33. Printer 34 prints on the paper 32 prescription information. The paper 32 is bent by a bending member 35 and the tablets past the discharge hopper 47 are sealed by heating rollers 36.

Likewise, either a single hopper 41 for a single cabinet 41 or double hoppers 41, 43 for a door cabinet and base cabinet is provided in the system. However, the kinetic force exerted on the dropping tablets results in unwanted dust and debris on the inner wall of the hoppers. Further, the tablet bounding and rebounding on the wall may cause tablet break or tablet split that may subsequently affect medication for an individual who should not be exposed to specific tablets.

SUMMARY OF THE INVENTION

The present invention is contrived to overcome the conventional disadvantages. Accordingly, it is an object of the present invention to provide an automatic tablet dispensing and packaging system having slider cabinets together with separate and individual hoppers for the slider cabinets so as to minimize occurrence of unwanted tablet bounding and rebounding. Another object of the present invention is to substantially decrease kinetic force of the tablets being dropped from the cassettes. A further object is to provide buffer sheets to initially diminish the kinetic force of the tablets. A still further object is to provide a detachable hoppers for slider cabinets.

To achieve these and other objects, the tablet supplying and packaging system according to the present invention comprises a prescription tablet packaging unit, a frame having a front top surface and a rear top surface. The packaging unit is incorporated within the frame and a base plate is formed on the frame rear top surface to form slide rails on top of the base plate. A tablet dropping unit having door cabinets and slider cabinets are provided such that the door cabinets are disposed on the frame front top surface and linearly aligned to become swiveled to each side portion of the tablet dropping unit to serve as a front double door of the table dropping unit.

The slider cabinets are slidably mounted on the base plate and horizontally aligned in rear of the door cabinets such that each longer side surface of the slider cabinets becomes perpendicular to each rear surface of the door cabinets. Here, the slider cabinets are linearly slidable on the slide rails to move back and forth so that the forward sliding (toward the door cabinet) of the slider cabinets can be effected when the door cabinets are swung open, whereby the slider cabinets are selectively pulled out through a space reserved by opening the door cabinets, the slider cabinets are partitioned in at least three pairs to enable a pair-by-pair sliding.

A plurality of tablet cassettes each containing therein and selectively releasing therefrom a predetermined type of tablets are detachably racked in said each cabinet in columns and rows. Each cabinet comprises a plurality of tablet passage channels to enable communication from the tablet cassettes to the hoppers. The tablet passage channels are correspondingly aligned with the tablet cassette columns to facilitate guiding the tablets from the tablet cassettes to the hoppers. The selectively released tablets are to pass through tablet passage channels correspondingly aligned with the tablet cassette columns.

In an embodiment, a front hopper is formed into the tablet packaging unit to communicate through the frame front top surface so as to guide the tablets released from the front cabinets to the packaging unit, and the installed front hopper is substantially rectangular when viewed atop to sufficiently cover the rear hoppers in rear thereof when front-viewed. Rear hoppers formed in rear of the front hopper and into the tablet packaging unit to communicate through the frame rear top surface and the base plate so as to guide the tablets released from the slider cabinets to the packaging unit, wherein the rear hoppers correspond to the slider cabinets in number. Each rear hopper is detachably mounted in the base plate and the frame rear top surface and substantially unleveled to minimize rebounding of the released tablets.

Meanwhile, the installed rear hoppers are each substantially rectangular when viewed atop, and a main hopper below the front and rear hoppers to collectively guide the tablets to the tablet packaging unit. One or more buffer sheets partially inserted in and along a lower and inner periphery of each tablet passage channel communicating with the corresponding hopper so as to minimize kinetic force of the tablets being dropped via the corresponding channel. The buffer sheets are substantially elastic against the periphery of said each tablet passage channel. The buffer sheets are substantially unleveled. The buffer sheets are downwardly unleveled. Further provided are a printer to print respective information on a packaging paper, and a heater assembly to package the tablets released through the hopper into one or more partitioned paper bags using the packaging paper. The heating assembly includes heating rollers to consecutively seal the packaging paper to the tablet containing paper bags.

The advantages of the present invention are numerous in that: (1) the separate and individual hoppers for the slider cabinets of the automatic tablet dispensing and packaging system substantially decreases the kinetic force exerted on the tablets being dropped from the cassettes and minimizes occurrence of unwanted dust and debris on the inner periphery of the hoppers, thereby improving product reliability; (2)

the buffer sheets of the system serve to initially diminish the kinetic force of the tablets to double the effects under which the tablets pass the hoppers safely and without damage to reach the packaging unit, thereby maximizing satisfaction of the pharmacists and system operators; and (3) the detachable hopper mechanism for the slider cabinets facilitate hopper cleaning and enables hopper maintenance in a cleaner manner, thereby improving usability and marketability.

Although the present invention is briefly summarized, the full understanding of the invention can be obtained by the following drawings, detailed description and appended claims.

BRIEF DESCIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
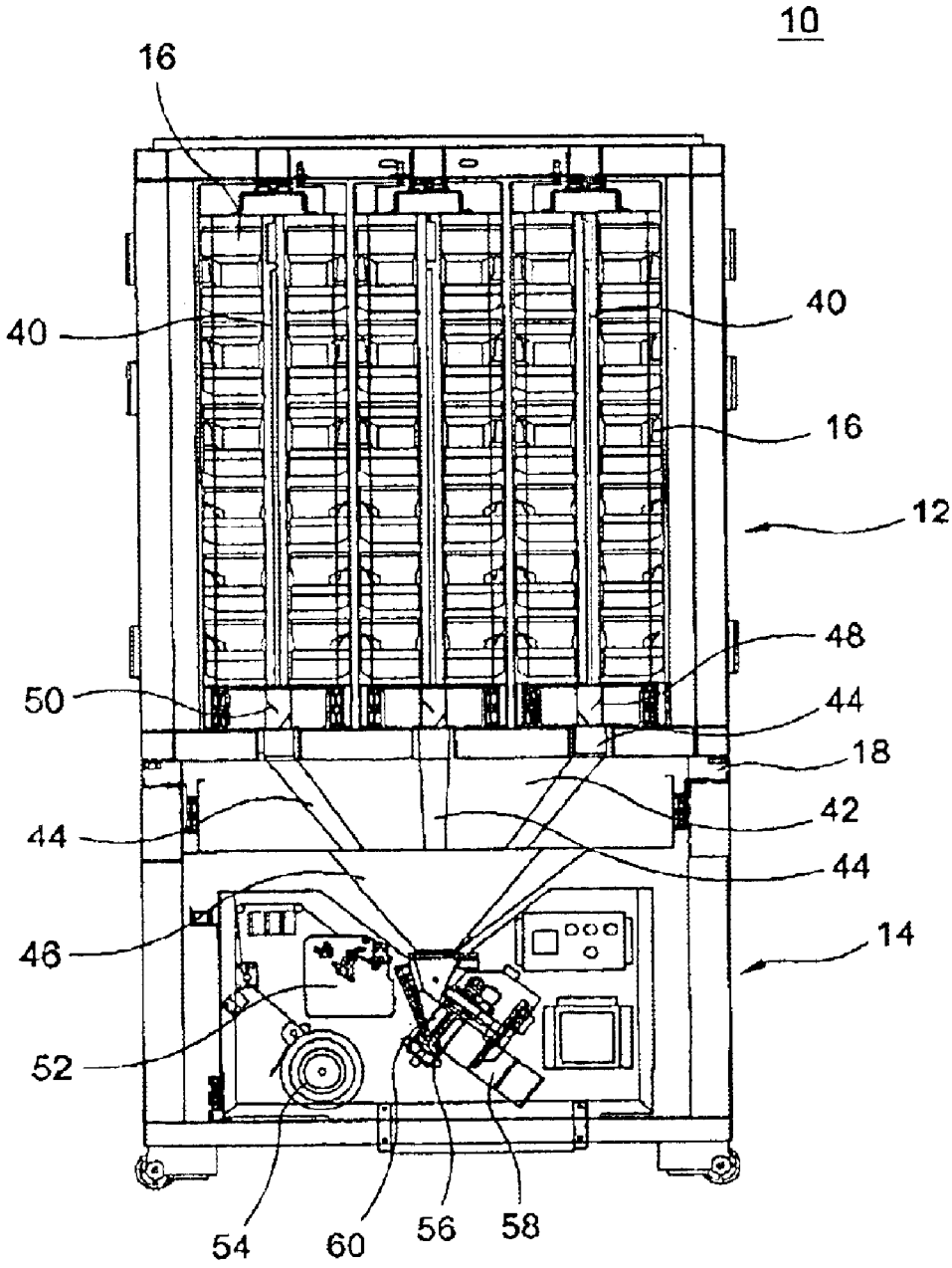
FIG. 1 is a front view of an automatic tablet dispensing and packaging system according to the present invention.
Figure 2:
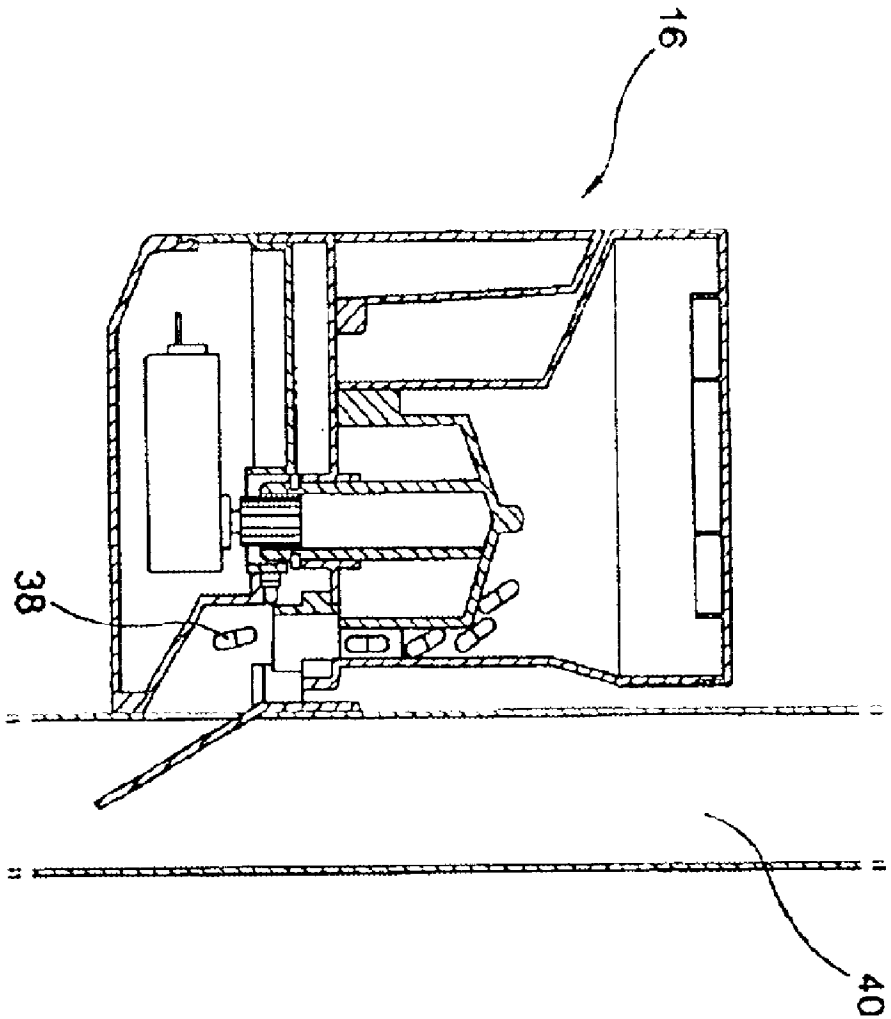
FIG. 2 is a view showing a tablet cassette mechanism according to the present invention.
Figure 3:
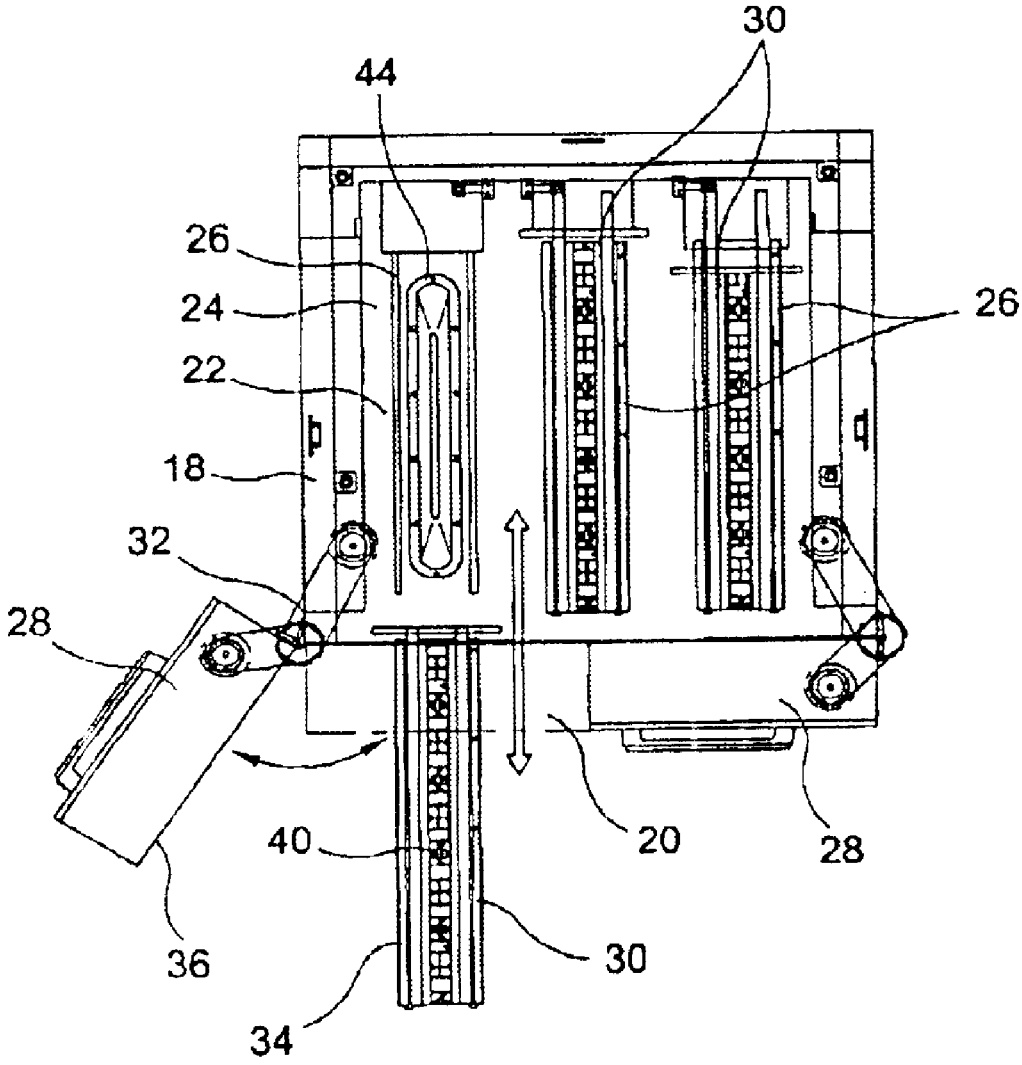
FIG. 3 is a view showing a slidable cabinet mechanism according to the present invention.
Figure 4:
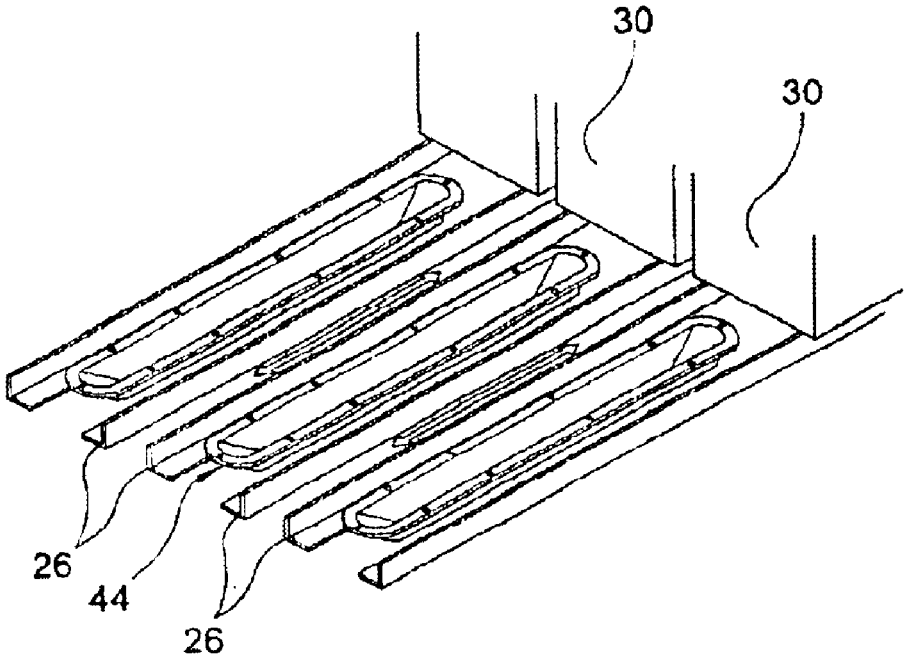
FIG. 4 is a view showing hoppers for slidable cabinets according to the present invention.
Figure 5:
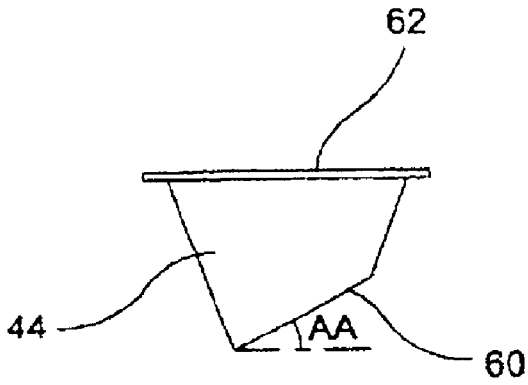
FIG. 5 is a side view showing the slidable cabinet hopper mechanism according to the present invention.
Figure 6:
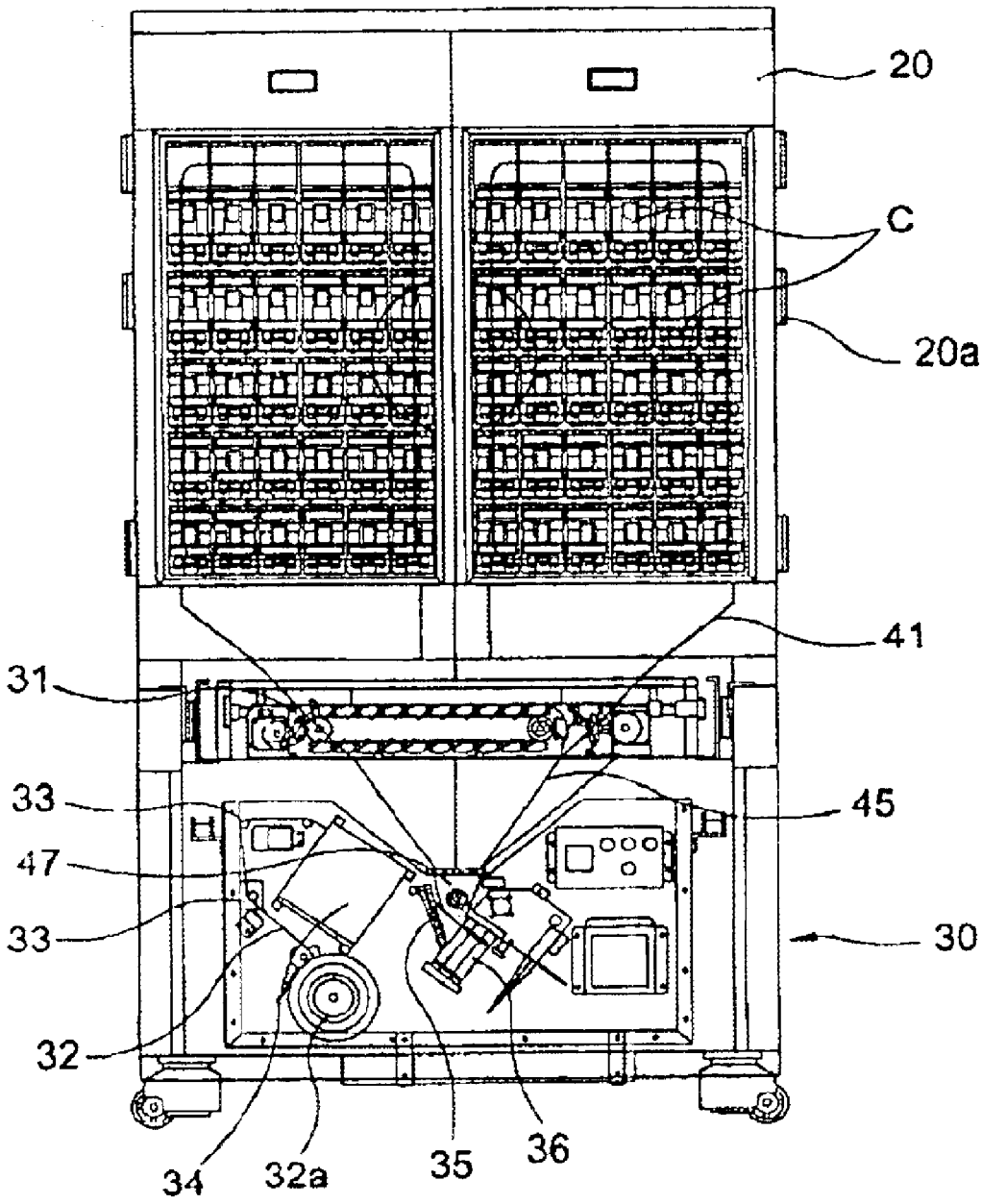
FIG. 6 Prior Art
FIGS. 6 and 7 are views each showing a prior art.
Figure 7:
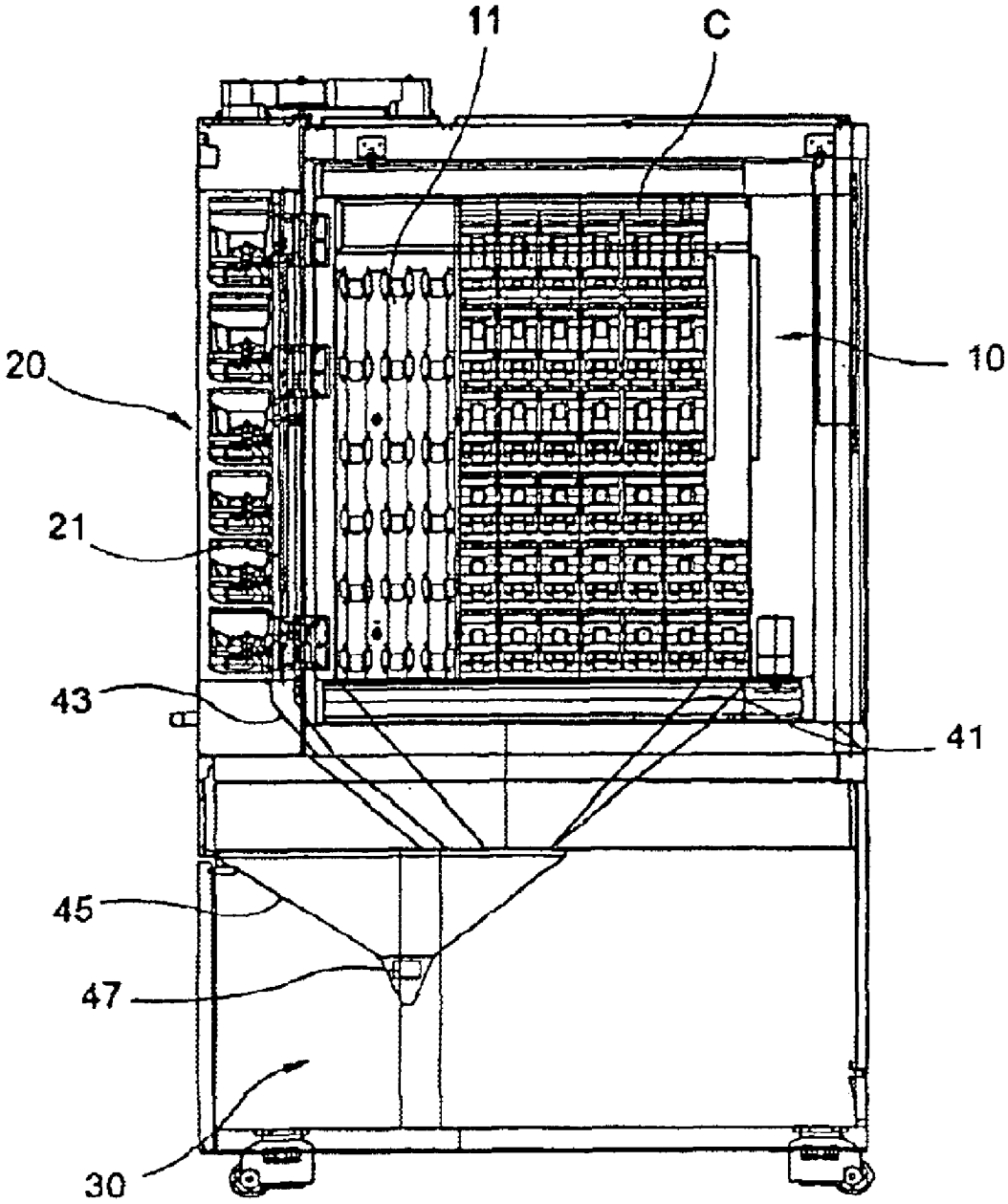
Fig. 7 Prior Art

FIG. 1 shows an automatic tablet dispensing and packaging system 10 according to the present invention, FIG. 2 shows a tablet dispensing mechanism, FIG. 4 shows a plan view showing multi-cabinet mechanism, FIG. 5 shows shopper mechanism for slider cabinet application, and FIG. 5 shows a side view of a hopper for the slide cabinet application. As shown therein, the system 10 comprises a tablet dropping unit 12, a prescription tablet packaging unit 14, and a plurality of tablet cassettes 16 detachably mounted in the packaging unit 14. A frame 18 is provided to partition the packaging unit 14 from the tablet dropping unit 12. The frame 18 has a front top surface 20 and a rear top surface 22. The packaging unit 14 is incorporated within the frame 18. A base plate 24 is formed on the frame rear top surface 22 to form slide rails 26 on top of the base plate 24.

The tablet dropping unit 12 is provided to have door cabinets 28 and slider cabinets 30. The door cabinets 28 are disposed on the frame front top surface 20 and linearly aligned to become swiveled to each side portion 32 of the tablet dropping unit 12 to serve as a front double door of the table dropping unit 12. The slider cabinets 30 are slidably mounted on the base plate 24 and horizontally aligned in rear of the door cabinets 28 such that each longer side surface 34 of the slider cabinets 30 becomes perpendicular to each rear surface 36 of the door cabinets 28.

In an embodiment, the slider cabinets 30 are linearly slidable on the slide rails 26 to move back and forth so that the forward sliding (toward the door cabinet 28) of the slider cabinets 30 can be effected when the door cabinets 28 are swung open, whereby the slider cabinets 30 are selectively pulled out through a space reserved by opening the door cabinets 28. The slider cabinets 30 are preferably partitioned in at least three pairs to enable a pair-by-pair sliding.

The plurality of tablet cassettes 16 each containing therein and selectively releasing therefrom a predetermined type of tablets 38 are detachably racked in each cabinet 28, 30 in columns and rows. Also, each cabinet 28, 30 comprises a plurality of tablet passage channels 40 to enable communication from the tablet cassettes 16 to guide down the tablets 38. The tablet passage channels 40 are correspondingly aligned with the tablet cassette columns to facilitate guiding the tablets 38 from the tablet cassettes 16 to guide down the tablets 38.

That is, the selectively released tablets 38 are to pass through tablet passage channels 40 which are correspondingly aligned with the tablet cassette columns. A front hopper 42 is formed into the tablet packaging unit 14 to communicate through the frame front top surface 20 so as to guide the tablets 38 released from the front cabinets 28 to the packaging unit 14. Preferably, the installed front hopper 42 is substantially rectangular when viewed atop to sufficiently cover the rear hoppers in rear thereof when front-viewed.

For a better performance, rear hoppers 44 are formed in rear of the front hopper 42 and into the tablet packaging unit 14 to communicate through the frame rear top surface 22 and the base plate 24 so as to guide the tablets 38 released from the slider cabinets 30 to the packaging unit 14. In a preferred mode, the rear hoppers 44 correspond to the slider cabinets 30 in number. Each rear hopper 44 is detachably mounted in the base plate 24 and the frame rear top surface 22. Each rear hopper 44 is substantially unleveled to minimize rebounding of the released tablets 38. The tablet bounding or rebounding may generate dust or debris of tablets 38 in and along the hoppers 42, 44 and a slight bit of tablet-generated dust or debris may cause an unwanted medication to a wrong patient. Therefore, the clean maintenance of the hoppers 42, 44 and the tablet passage channels 40 are one of the most significant issues among drugstores using the system 10.

Meanwhile, it is recommended that the installed rear hoppers 44 are each formed substantially rectangular when viewed atop. The bottom line 60 of each rear hopper 44 may be substantially unleveled to minimize rebounding of the released tablets 38. Preferably, an angle AA formed by the bottom line 60 and the top line 62 is between about five (5) and twenty five (25) degrees. For the best performance, the angle AA is about fifteen (15) degrees. Selectively, a main hopper 46 is provided below the front and rear hoppers 42, 44 to collectively guide the tablets 38 to the tablet packaging unit 14.

In an embodiment, one or more buffer sheets 48 are partially inserted in and along a lower and inner periphery 50 of each tablet passage channel 40 communicating with the corresponding hopper 42 or 44 so as to minimize kinetic force of the tablets 38 being dropped via the corresponding channel 40. The buffer sheets 48 are substantially elastic against the lower periphery 50 of each tablet passage channel 40. Preferably, the buffer sheets are downwardly unleveled.

The tablet packaging unit 14 includes a printer 52 to print respective information on a packaging paper 54, and a heater assembly 56 to package the tablets 38 released through the hoppers 42, 44 into one or more partitioned paper bags 58 using the packaging paper 54. The heating assembly 56 includes heating rollers 60 to consecutively seal the packaging paper 54 to the tablet containing paper bags 58.

As discussed above, an advantages of the present invention is that the separate and individual rear hoppers 44 for the slider cabinets 30 of the automatic tablet dispensing and packaging system 10 substantially decreases the kinetic force exerted on the tablets 38 being dropped from the cassettes 16 and minimizes occurrence of unwanted dust and debris on the inner periphery 50 of the hoppers 44, thereby improving product reliability. In addition, the buffer sheets 48 of the system 10 serve to initially diminish the kinetic force of the tablets 38 to double the effects under which the tablets 38 pass the rear hoppers 44 safely and without damage to reach the packaging unit 14, thereby maximizing satisfaction of the pharmacists and system operators. Further, the detachable hopper mechanism for the slider cabinets 30 facilitate hopper cleaning and enables hopper maintenance in a cleaner manner, thereby improving usability and marketability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An automatic tablet dispensing and packaging system, comprising:

a) a prescription tablet packaging unit;

b) a frame having a front top surface and a rear top surface, wherein the packaging unit is incorporated within the frame, wherein a base plate is formed on the frame rear top surface to form slide rails on top of the base plate;

c) a tablet dropping unit having door cabinets and slider cabinets, wherein the door cabinets are disposed on the frame front top surface and linearly aligned to become swiveled to each side portion of the tablet dropping unit to serve as a front double door of the table dropping unit, wherein the slider cabinets are slidably mounted on the base plate and horizontally aligned in rear of the door cabinets such that each longer side surface of the slider cabinets becomes perpendicular to each rear surface of the door cabinets, wherein the slider cabinets are linearly slidable on the slide rails to move back and forth so that the forward sliding (toward the door cabinet) of the slider cabinets can be effected when the door cabinets are swung open, whereby the slider cabinets are selectively pulled out through a space reserved by opening the door cabinets;

d) a plurality of tablet cassettes each containing therein and selectively releasing therefrom a predetermined type of tablets, wherein the tablet cassettes are detachably racked in said each cabinet in columns and rows;

e) a front hopper formed into the tablet packaging unit to communicate through the frame front top surface so as to guide the tablets released from the front cabinets to the packaging unit; and f) rear hoppers formed in rear of the front hopper and into the tablet packaging unit to communicate through the frame rear top surface and the base plate so as to guide the tablets released from the slider cabinets to the packaging unit, wherein the rear hoppers correspond to the slider cabinets in number, wherein said each rear hopper is detachably mounted in the base plate and the frame rear top surface, wherein a bottom line of said each rear hopper is substantially unleveled to minimize rebounding of the released tablets.

2. The system of claim 1 further comprising a main hopper below the front and rear hoppers to collectively guide the tablets to the tablet packaging unit.

3. The system of claim 1 wherein the installed rear hoppers are each substantially rectangular when viewed atop.

4. The system of claim 1 wherein the installed front and rear hoppers are each substantially rectangular when viewed atop.

5. The system of claim 1 wherein the tablet packaging unit comprises:

a) a printer to print respective information on a packaging paper; and b) a heater assembly to package the tablets released through the hoppers into one or more partitioned paper bags using the packaging paper.

6. The system of claim 5 wherein the heating assembly includes heating rollers to consecutively seal the packaging paper to the tablet containing paper bags.

7. The system of claim 1 wherein the slider cabinets are partitioned in at least three pairs to enable a pair-by-pair sliding.

8. The system of claim 1 wherein said each cabinet comprises a plurality of tablet passage channels to enable communication from the tablet cassettes to the hoppers, wherein the tablet passage channels are correspondingly aligned with the tablet cassette columns to facilitate guiding the tablets from the tablet cassettes to the hoppers.

9. An automatic tablet dispensing and packaging system, comprising:

a) a prescription tablet packaging unit;

b) a frame having a front top surface and a rear top surface, wherein the packaging unit is incorporated within the frame, wherein a base plate is formed on the frame rear top surface to form slide rails on top of the base plate;

c) a tablet dropping unit having door cabinets and slider cabinets, wherein the door cabinets are disposed on the frame front top surface and linearly aligned to become swiveled to each side portion of the tablet dropping unit to serve as a front double door of the table dropping unit, wherein the slider cabinets are slidably mounted on the base plate and horizontally aligned in rear of the door cabinets such that each longer side surface of the slider cabinets becomes perpendicular to each rear surface of the door cabinets, wherein the slider cabinets are linearly slidable on the slide rails to move back and forth so that the forward sliding (toward the door cabinet) of the slider cabinets can be effected when the door cabinets are swung open, whereby the slider cabinets are selectively pulled out through a space reserved by opening the door cabinets;

d) a plurality of tablet cassettes each containing therein and selectively releasing therefrom a predetermined type of tablets, wherein the tablet cassettes are detachably racked in said each cabinet in columns and rows, wherein the selectively released tablets are to pass through tablet passage channels correspondingly aligned with the tablet cassette columns;

e) a front hopper formed into the tablet packaging unit to communicate through the frame front top surface so as to guide the tablets released from the front cabinets to the packaging unit;

f) rear hoppers formed in rear of the front hopper and into the tablet packaging unit to communicate through the frame rear top surface and the base plate so as to guide the tablets released from the slider cabinets to the packaging unit, wherein the rear hoppers correspond to the slider cabinets in number, wherein said each rear hopper is detachably mounted in the base plate and the frame rear top surface, wherein a bottom line of said each rear hopper is substantially unleveled to minimize rebounding of the released tablets; and g) one or more buffer sheets partially inserted in and along a lower and inner periphery of said each tablet passage channel communicating with the corresponding hopper so as to minimize kinetic force of the tablets being dropped via the corresponding channel.

10. The system of claim 9 wherein the buffer sheets are substantially elastic against the periphery of said each tablet passage channel.

11. The system of claim 9 wherein the buffer sheets are substantially unleveled.

12. The system of claim 9 wherein the buffer sheets are substantially unleveled and elastic against the periphery of said each tablet passage channel.

13. The system of claim 9 wherein the buffer sheets are downwardly unleveled.

14. The system of claim 9 wherein the buffer sheets are downwardly unleveled and substantially elastic against the periphery of said each tablet passage channel.

15. The system of claim 9 further comprising a main hopper below the front and rear hoppers to collectively guide the tablets to the tablet packaging unit.

16. The system of claim 9 wherein the installed rear hoppers are each substantially rectangular when viewed atop.

17. The system of claim 9 wherein the installed front and rear hoppers are each substantially rectangular when viewed atop.

18. The system of claim 9 wherein the tablet packaging unit comprises:

a) a printer to print respective information on a packaging paper; and b) a heater assembly to package the tablets released through the hoppers into one or more partitioned paper bags using the packaging paper.

19. The system of claim 18 wherein the heating assembly includes heating rollers to consecutively seal the packaging paper to the tablet containing paper bags.

20. The system of claim 9 wherein the slider cabinets are partitioned in at least three pairs to enable a pair-by-pair sliding.

* * * * *